US009829284B2

(12) United States Patent
Bendickson et al.

(10) Patent No.: US 9,829,284 B2
(45) Date of Patent: Nov. 28, 2017

(54) OPTOELECTRONICS SYSTEM AND METHODS

(71) Applicant: ROCKWELL COLLINS, INC., Cedar Rapids, IA (US)

(72) Inventors: John G Bendickson, Vinton, IA (US); Mitchell A. Riley, Marion, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 168 days.

(21) Appl. No.: 14/864,242

(22) Filed: Sep. 24, 2015

(65) Prior Publication Data

US 2017/0089671 A1 Mar. 30, 2017

(51) Int. Cl.

| | |
|---|---|
| ***H01J 40/14*** | (2006.01) |
| ***F41H 13/00*** | (2006.01) |
| ***H01J 31/50*** | (2006.01) |
| ***H05B 37/02*** | (2006.01) |
| ***H05B 33/08*** | (2006.01) |

(52) U.S. Cl.

CPC ..... *F41H 13/0087* (2013.01); *H01J 31/50* (2013.01); *H05B 33/0857* (2013.01); *H05B 37/0281* (2013.01)

(58) Field of Classification Search

CPC ..... G01S 7/495; F41H 13/0087

See application file for complete search history.

(56) References Cited

U.S. PATENT DOCUMENTS 6,285,018 B1 9/2001 Aebi et al.

7,830,926 B1 * 11/2010 Kim ..... B82Y 20/00 372/20

2005/0161588 A1 * 7/2005 Kominsky ..... H04N 5/238 250/214 VT

2005/0247862 A1 * 11/2005 Faytlin ..... B60R 1/00 250/214 VT

OTHER PUBLICATIONS

"EBAPS Technology", Product Information Sheet for Intevac's Core Sensor Technology, 2015, Intevac, Inc.

"How Night Vision Works—Terminology", Retrieved: Sep. 19, 2015, http://www.bibliotecapleyades.net/ciencia/secret_projects/project281.htm.

* cited by examiner

*Primary Examiner* — Thanh Luu

(74) *Attorney, Agent, or Firm* — Daniel M. Barbieri; Donna P. Suchy; Angel N. Gerdzhikov

(57) ABSTRACT

Methods performed by an optoelectronic system are disclosed. A first method may be performed by a pulse data generator configured to acquire time from a clock; determine pulse data representative of a sequence of duration times and/or wavelength ranges as a function of, in part, a wavelength hopping algorithm; and determine and generate an output for controlling an operation of at least one optoelectronic system. A second method may be performed by a sensor controller configured to acquire the pulse data; and generate an output for controlling an operation of an optoelectronic system employed to produce an image viewable to a viewer. A third method may be performed by an image generator configured to acquire the pulse data; acquire digital data from an optoelectronic system; and generate image data representative of an image represented in data acquired from the optoelectronic system as a function of the pulse data.

20 Claims, 10 Drawing Sheets

Night Vision Device

Night Vision Device

160 Image Intensifier Tube

170 EBAPS ®

| time | duration (sec) | wavelength range |
|---|---|---|
| t(0) | 0.1 | IR |
| t(1) | 5.0 | N/A |
| t(2) | 0.2 | UV |
| t(3) | 3.0 | N/A |
| t(4) | 0.1 | VIS |
| t(5) | 4.0 | N/A |
| t(6) | 0.8 | IR, UV |
| t(7) | 10.0 | N/A |

| time | duration (sec) | wavelength range | V |
|---|---|---|---|
| t(0) | 0.1 | IR | V0 |
| t(1) | 5.0 | N/A | -V3 |
| t(2) | 0.2 | UV | -V2 |
| t(3) | 3.0 | N/A | -V3 |
| t(4) | 0.1 | VIS | -V1 |
| t(5) | 4.0 | N/A | -V3 |
| t(6) | 0.8 | IR, UV | V0 |
| t(7) | 10.0 | N/A | -V3 |

OPTOELECTRONICS SYSTEM AND METHODS

BACKGROUND

A night vision device (NVD) is an optoelectronic device that produces an image in low levels in light and various wavelength ranges of the electromagnetic spectrum such as those ranges encompassing radiation of visible and infrared wavelengths. Because the NVD aids an individual to see in the dark, it is suitable for many operations such as, but not limited to, military and law enforcement personnel who could benefit "under the cover of darkness."

Traditional NVDs employ an analog sensor referred to as an image intensifier tube (IIT) as shown in FIG. 1A. Light energy comprised of photons and found in a small amount of light such as moonlight or starlight may be converted by the IIT into electrical energy comprised of electrons that are then subjected to an electron manipulation process prior to being converted back into photons from which a visible image of a scene is produced. Even if the actual scene is not visible to the naked eye, an image of the scene may nevertheless be visible when a viewer is wearing an NVD employing the IIT.

A recent generation of an NVD employs a digital sensor referred to as Electron Bombarded Active Pixel Sensor (EBAPS®) as shown in FIG. 1B. Similar to the IIT, light energy comprised of photons may be converted by the digital sensor into electrical energy comprised of electrons. Instead of converting the electrons back into photons, an imaging sensor creates digital data representative of the image of the actual scene. Even if the actual scene is not visible to the naked eye, an image of the scene may nevertheless be visible as a digital image when a viewer is wearing an NVD employing the digital sensor.

Although an NVD aids a viewer's ability to see in the dark, an exposure to sudden, intense radiation could affect the viewer's ability to see, even when the NVD is being worn. To compensate for this momentary detrimental effect, electronic features have been developed. For instance, an automatic brightness control has been developed to reduce a voltage applied to a microchannel plate of the IIT to keep a brightness of the IIT within optimal limits, thereby protecting the IIT. Also, a bright-source protection has been developed to reduce a voltage applied to a photocathode found in the IIT to protect the IIT and enhance its life; however, the reduction of the voltage has the negative effect of lowering the light gain and/or resolution.

SUMMARY

Embodiments of the inventive concepts disclosed herein are directed to methods performed by an optoelectronic system. When these methods are performed, negative effects experienced by sudden exposures to bright and/or intensive flashes of radiation may be effectively countered while also providing a level of protection to both the analog and digital sensors.

In one aspect, embodiments of the inventive concepts disclosed herein are directed to a method performed by a pulse data generator (PDG) configured to acquire a reference time; determine pulse data representative of a sequence of duration times and/or wavelength ranges as a function of the first time and a wavelength hopping algorithm; and determine and generate an output for controlling an operation of at least one optoelectronic system as a function of the pulse data. In some embodiments, the wavelength hopping algorithm is comprised of a cryptographic algorithm and a key. In some embodiments, an optoelectronic system could be an optoelectronic system employed to produce an image viewable to a viewer and/or employed to generate flashes of radiation of one or more wavelength ranges.

In a further aspect, embodiments of the inventive concepts disclosed herein are directed to a method performed by a sensor controller configured to acquire the pulse data; and generate an output for controlling an operation of an optoelectronic system employed to produce an image viewable to a viewer as a function of the pulse data being acquired.

In a further aspect, embodiments of the inventive concepts disclosed herein are directed to a method performed by an image generator configured to acquire the pulse data; acquire digital data from an optoelectronic system representative of a scene; and generate image data representative of an image represented in digital data as a function of the pulse data.

DETAILED DESCRIPTION

In the following description, several specific details are presented to provide a thorough understanding of embodiments of the inventive concepts. One skilled in the relevant art will recognize, however, that the inventive concepts can be practiced without one or more of the specific details, or in combination with other components, etc. In other instances, well-known implementations or operations are not shown or described in detail to avoid obscuring aspects of various embodiments of the inventive concepts.

Figure 1A:
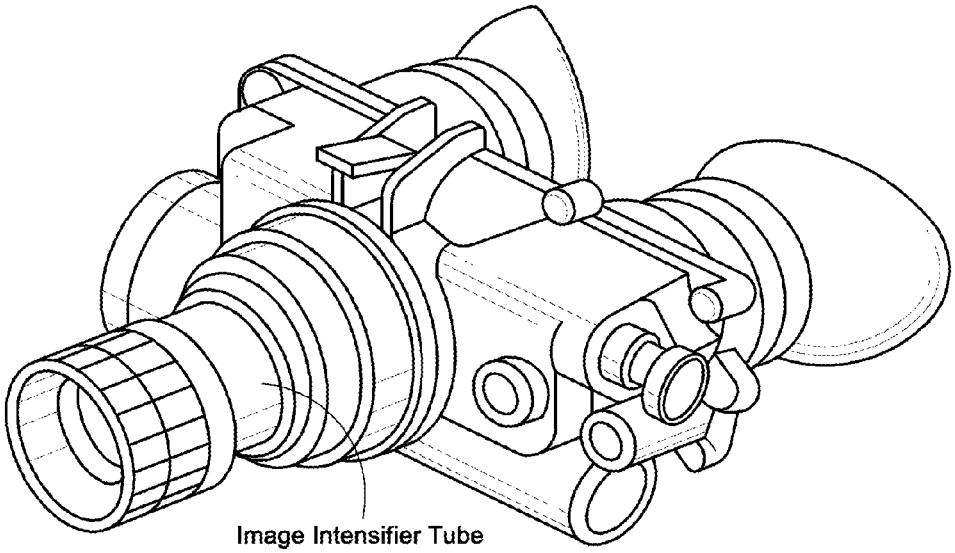
FIG. 1A depicts a night vision device (NVD) equipped with an image intensifier tube (IIT).
Figure 1B:
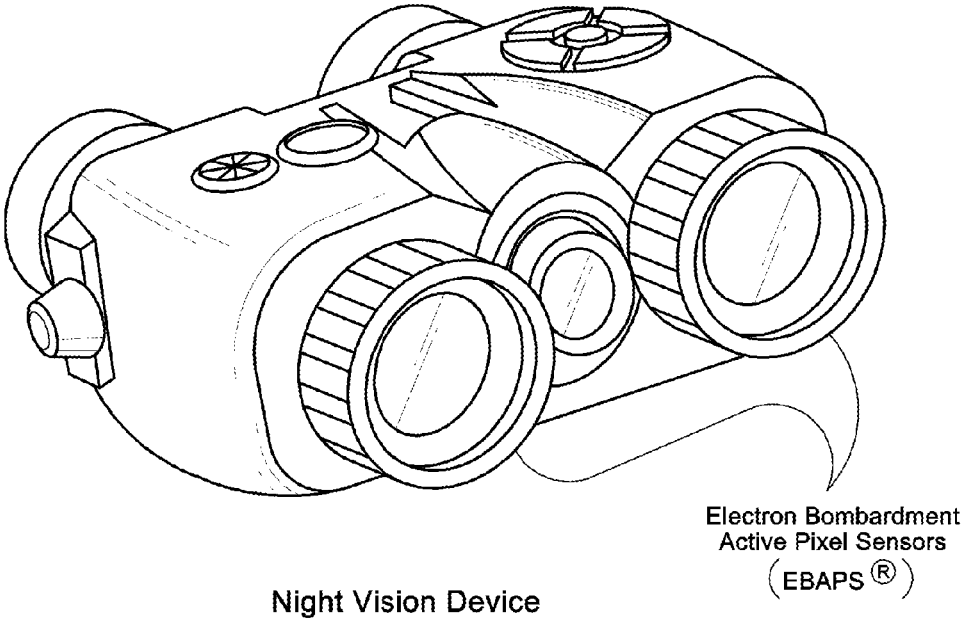
FIG. 1B depicts an NVD equipped with electron bombardment active pixel sensors (EBAPS®).
Figure 2A:
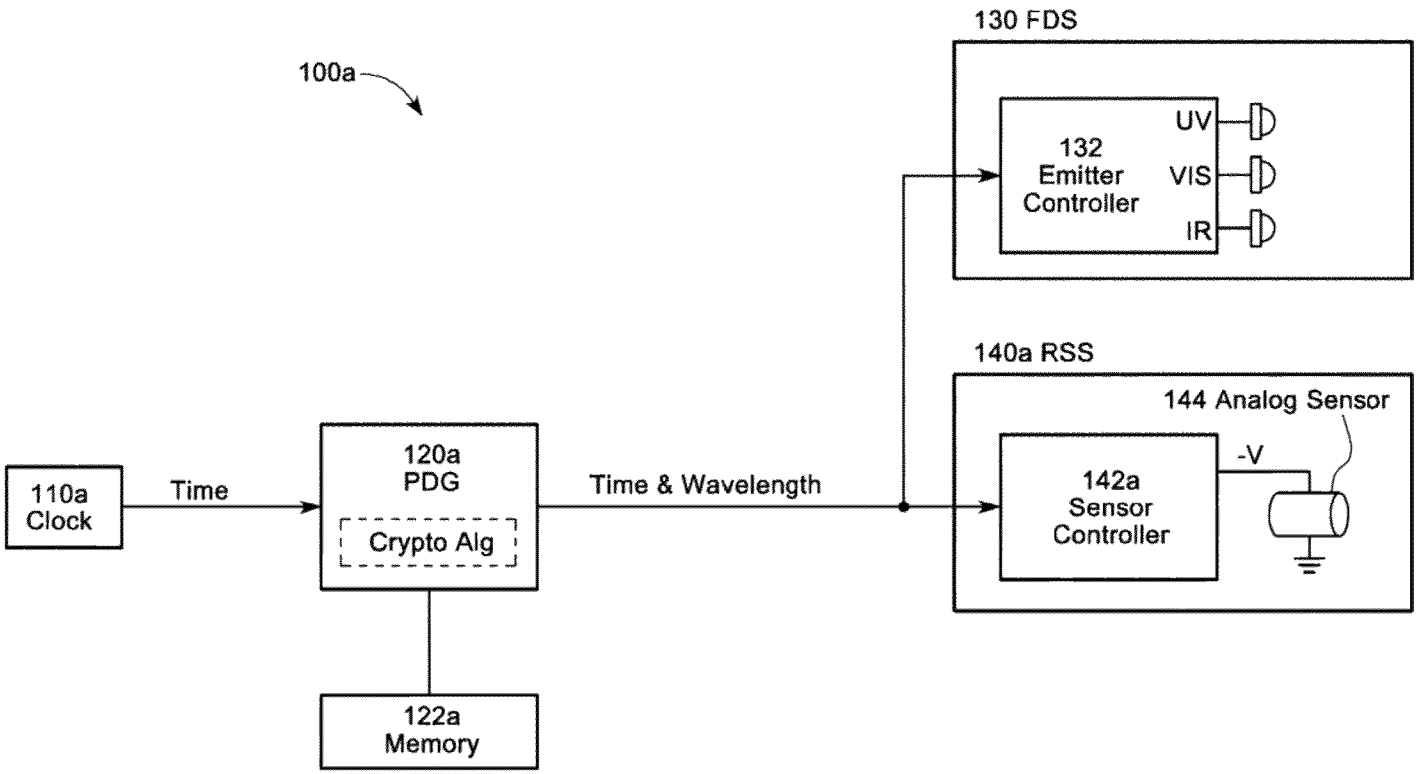
FIG. 2A depicts a functional block diagram of a first configuration of an optoelectronic system.
Figure 2B:
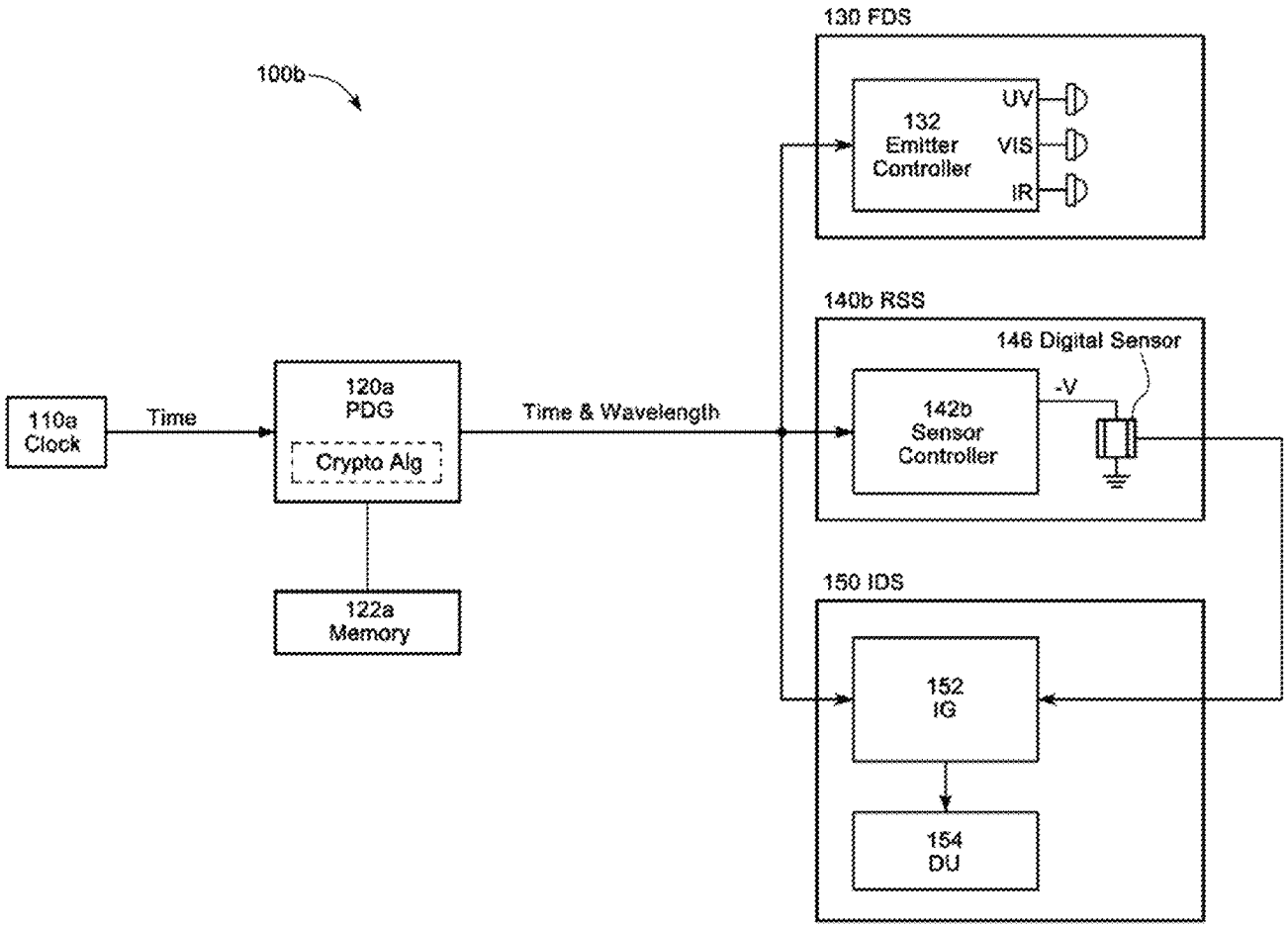
FIG. 2B depicts a functional block diagram of a second configuration of an optoelectronic system.
Figure 2C:
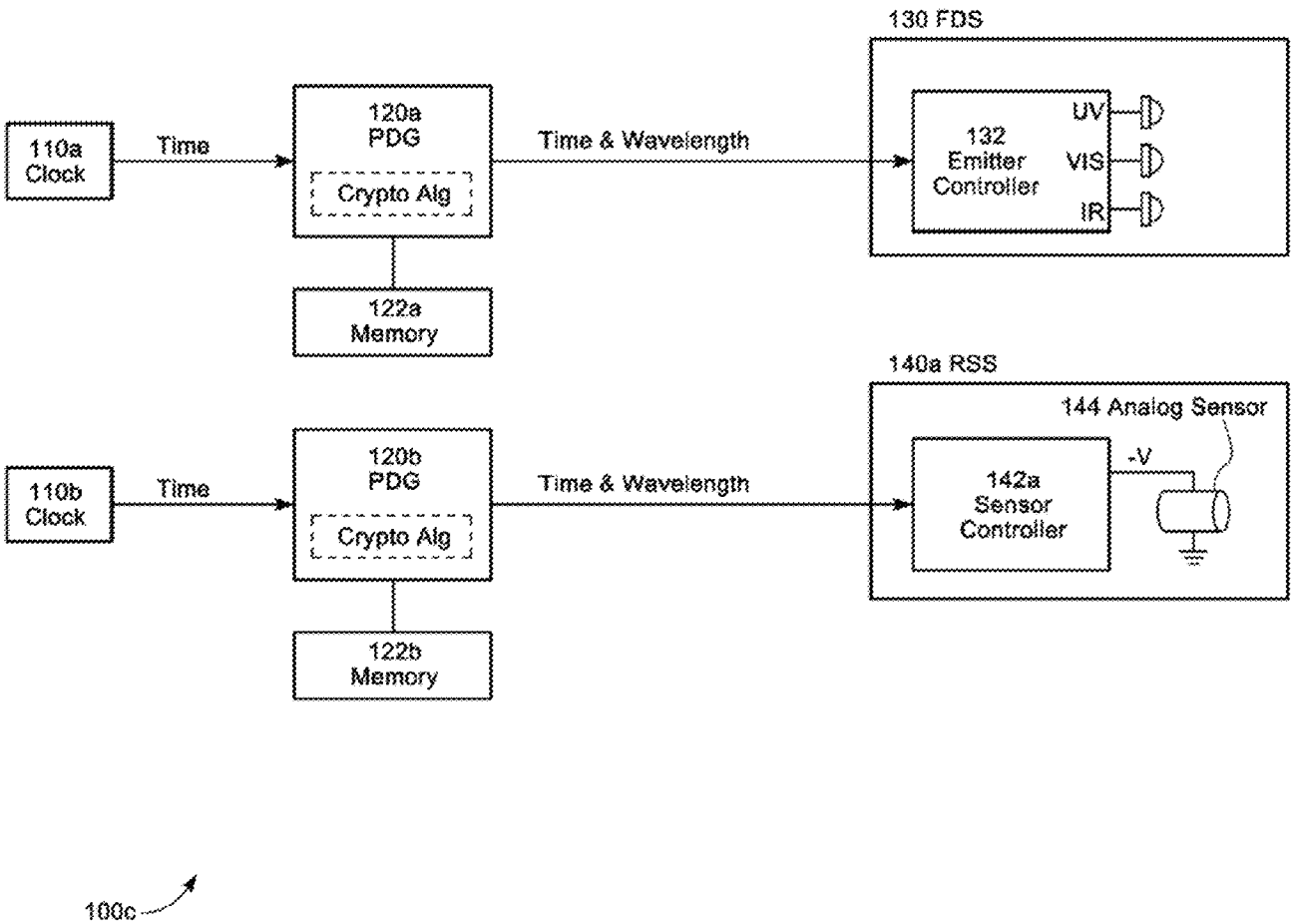
FIG. 2C depicts a functional block diagram of a third configuration of an optoelectronic system.
Figure 2D:
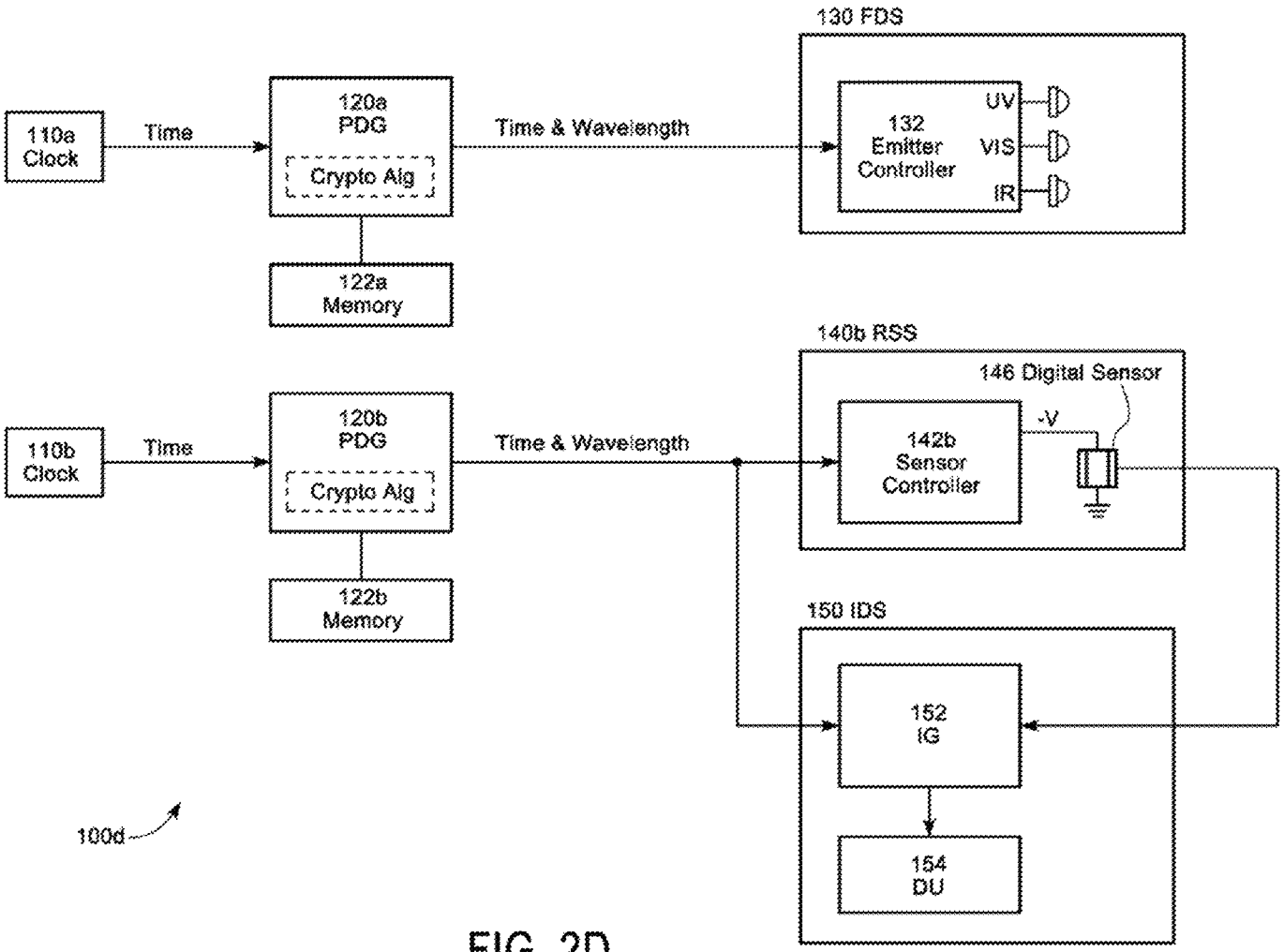
FIG. 2D depicts a functional block diagram of a fourth configuration of an optoelectronic system.

FIGS. 2A through 2D depict functional block diagrams for four exemplary configurations of an optoelectronic system 100 suitable for implementation of the techniques described herein. As shown in FIGS. 2A and 2B, functional block diagrams 100*a* and 100*b* include a clock 110*a*, a pulse data generator (PDG) 120*a*, a flash device system (FDS) 130, and a radiation sensing system (RSS) 140*a* or 140*b*; FIG. 2B includes an image generating system (IGS) 150. As shown in FIG. 2C, functional block diagram 100*c* includes clocks 110*a* and 110*b*, PDGs 120*a* and 120*b*, the FDS 130, and the RSS 140*a*. As shown in FIG. 2D, functional block diagram 100*d* include clocks 110*a* and 110*b*, PDGs 120*a* and 120*b*, the FDS 130, the RSS 140*b*, and the IGS 150.

Clocks 110*a* and 110*b* may include any source for providing a time such as, but not limited to, the time of day to PDGs 120*a* and 120*b*, respectively. In those embodiments such as those shown in functional block diagrams 100*c* and 100*d* in which more than one PDG is employed, then the time provided by the clock 110*a* and the time provided by the clock 110*b* may be synchronized with each other.

PDGs 120*a* and 120*b* may include any source such as an electronic circuit employed to generate pulses. In some embodiments, a pulse may be comprised of a rapid, transient change in the amplitude of a signal from a baseline value to a higher or lower value, followed by a return to the baseline value. In some embodiments, a pulse may be comprised of a rapid change in the characteristic of a signal (such as the phase or frequency) from a baseline value to a higher or lower value, followed by a return to the baseline value. In some embodiments, the shape of the pulse could include, but not be limited to, a rectangular shape or a sinusoidal shape.

PDGs 120*a* and 120*b* (and an emitter controller 132, sensor controllers 142*a* and 142*b*, and an IG 152) could include any electronic data processing unit which executes software or computer instruction code that could be stored, permanently or temporarily, in a digital memory storage device or a non-transitory computer-readable media (generally, memory 122) including, but not limited to, random access memory (RAM), read-only memory (ROM), compact disc (CD), hard disk drive, diskette, solid-state memory, secure digital cards, and compact flash cards. PDGs 120*a* and 120*b* may be driven by the execution of software or computer instruction code containing algorithms developed for the specific functions embodied herein. PDGs 120*a* and 120*b* may be an application-specific integrated circuit (ASIC) customized for the embodiments disclosed herein. Common examples of electronic data processing units are microprocessors, Digital Signal Processors (DSPs), Programmable Logic Devices (PLDs), Programmable Gate Arrays (PGAs), and signal generators; however, for the embodiments herein, the term "processor" is not limited to such processing units and its meaning is not intended to be construed narrowly. For instance, PDGs 120*a* and 120*b* could also consist of more than one electronic data processing unit. In some embodiments, PDGs 120*a* and 120*b* could be processor(s) used by or in conjunction with any other system or controller discussed herein.

In some embodiments, data could be comprised of any analog or digital signal, either discrete or continuous, which could contain information or be indicative of information. In some embodiments, the terms "programmed" and "configured" are synonymous. PDGs 120*a* and 120*b* may be electronically coupled to systems and/or sources to facilitate the receipt of input data. In some embodiments, operatively coupled may be considered as interchangeable with electronically coupled. It is not necessary that a direct connection be made; instead, such receipt of input data and the providing of output data could be provided through a data bus, through a wireless network, or as a signal received and/or transmitted by PDGs 120*a* and 120*b* via a physical or a virtual computer port. PDGs 120*a* and 120*b* may be programmed or configured to provide output pulse data to various systems and/or units including, but not limited to, the FDS 130, RSSs 140*a* and 140*b*, and/or the IGS 150.

PDGs 120*a* and 120*b* may be programmed or configured to execute a wavelength hopping function or method for rapidly switching or hopping between ranges of wavelengths for rapidly switching periods or durations of times. Similar to a frequency-hopping spread spectrum method used in communications systems, the wavelength hopping function disclosed herein may employ a time-based, pseudorandom sequence that has been determined from a cryptographic algorithm and key, and the input of time from clocks 110*a* and 110*b*. In some embodiments, the wavelength hopping function may employ a time-based, predefined sequence that has been determined by a user-defined algorithm tailored to the needs of the user or the mission of military personnel in attempt to inflict momentary blindness upon the adversary through the use of well-timed flashes produced by the FDS 130. To ensure that the user or military personnel are not blinded by the output of the FDS 130 and/or to ensure that RSSs 140*a* and 140*b* do not experience a detrimental effect resulting from rapid or momentary flashes, RSSs 140*a* and 140*b* may be controlled by the same pseudorandom sequence or predefined sequence to cease or suppress radiation sensing and/or image production.

The FDS 130 may include any device or system for producing flashes of radiation in wavelength ranges of the electromagnetic spectrum defined as, but not limited to, ultraviolet (UV) radiation, visible radiation (VIS), and infrared (IR) radiation. The FDS 130 may include the emitter controller 132, a device configured to determine and generate an output for generating flashes of radiation of one or more wavelength ranges and/or one or more time durations in response to pulse data being acquired from PDGs 120*a* and 120*b*. For the purpose of illustration and not of limitation, the emitter controller 132 has been configured to generate an output which will result in flashes of UV radiation, VIS radiation, and/or IR radiation. In some embodiments, clocks 110*a* and/or 110*b* and PDGs 120*a* and/or 120*b* may be incorporated into and/or integrated with their corresponding FDS 130.

The breadth of ranges produced by the FDS 130 may be configurable by the user and may be very broad or very narrow. In some embodiments, the flashes could be produced by light emitting diode (LED) technology having relatively fast rise and fall times. In some embodiments, the FDS 130 could be a small, hand-held device capable of being tossed like a hand grenade. In some embodiments, the FDS 130 could be included on a vehicle which is designed to be operated on the ground, in the sky, or underwater. For the purpose of illustration and not of limitation, the FDS 130 could be floated or flown by a balloon or remotely-controlled unmanned vehicle, respectively.

RSSs 140*a* and 140*b* may include any device or system for receiving radiation and generating an image presentable to a viewer. The RSS 140*a* may include the sensor controller 142*a* and an analog sensor 144; the RSS 140*b* may include the sensor controller 142*b* and a digital sensor 146. Sensor controllers 142*a* and 142*b* may be devices configured to determine and generate an outputs that are provided to the analog sensor 144 or the digital sensor 146, respectively, for reducing or suppressing a functionality of an optoelectronic device such as the sensor in response to pulse data being acquired from the PDG 120.

The IGS 150 may include any device or system for generating, presenting, and pausing a viewable image. The IGS 150 may include an image generator (IG) 152 and a display unit (DU) 154. In some embodiments, that IG 152 may generate image data from digital data being acquired from the digital sensor 146 and provide the image data to the DU 154. The generation of the image data may be paused for a brief period in response to pulse data being acquired from PDGs 120*a* or 120*b*.

Figure 3A:
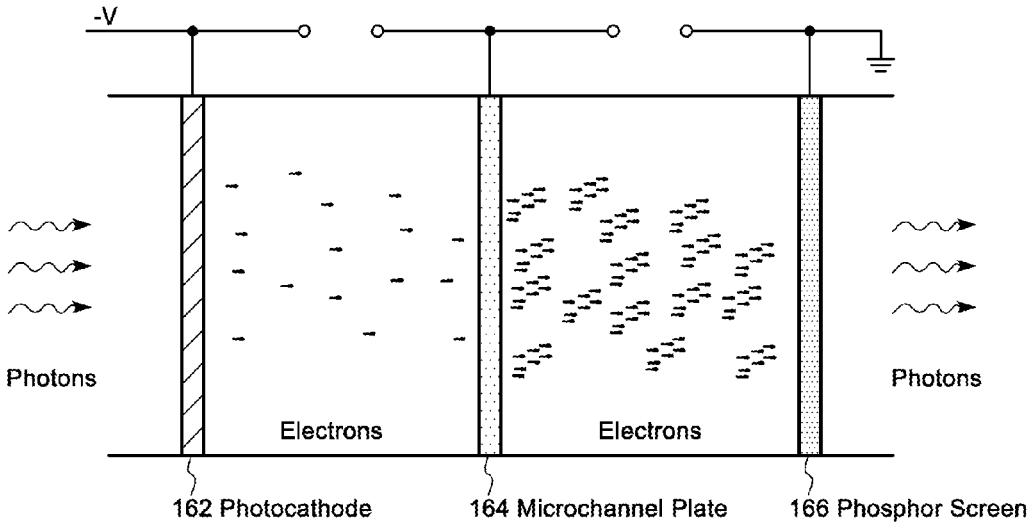
FIG. 3A depicts an exemplar of an analog sensor comprised of an IIT.

Referring now to FIG. 3A, an example of the analog sensor 144 comprised of an image intensifier tube (IIT) 160 in shown. In some embodiments, the IIT 160 could include a negatively-biased photocathode 162, a higher-voltage microchannel plate 164, and a phosphor screen 166 having a higher voltage than the microchannel 164. Generally, photons of radiation strike the photocathode 162, allowing electrons to be emitted. Because of the higher voltage, the electrons are accelerated towards the microchannel plate 164. Each electron striking the microchannel plate 164 results in multiple electrons being released and, because of the even higher voltage, drawn towards the phosphor screen 166. Electrons that strike the phosphor screen 166 cause the phosphor to produce photons of light that are viewable through one or more lenses.

Figure 3B:
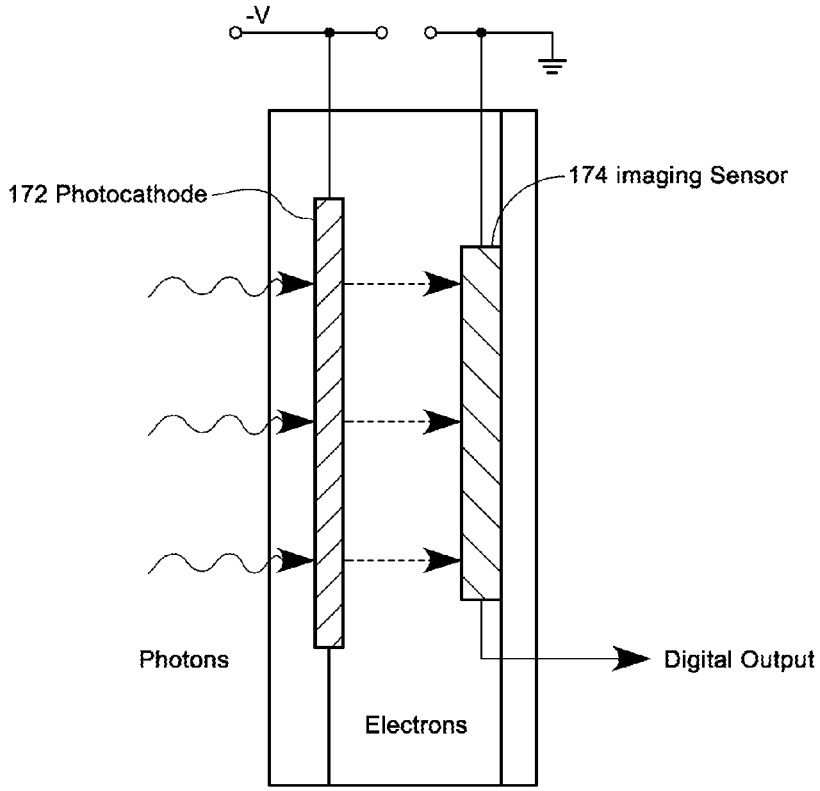
FIG. 3B depicts an exemplar of a digital sensor comprised of an EBAPS®.

Referring now to FIG. 3B, an example of the digital sensor 146 comprised of an Electron Bombarded Active Pixel Sensor (EBAPS®) 170 is illustrated. An example of a digital sensor was disclosed by Aebi et. al. in U.S. Pat. No. 6,285,018 entitled "Electron Bombarded Active Pixel Sensor" and at the time of this writing, is being developed and manufactured by Intevac, Inc. of Santa Clara, Calif. The EBAPS® 170 could include a negatively-biased photocathode 172 and a silicon imaging sensor 174. Generally, photons of radiation strike the photocathode 172, allowing electrons to be emitted. Because of the higher voltage, the electrons are accelerated and collected on the silicon imaging sensor 174 such as, for example, a megapixel CMOS (Complementary Metal-Oxide-Semiconductor) silicon sensor. A digital output data is produced and from which an image represented in the digital output data and presentable to a viewer may be produced.

Figure 4:
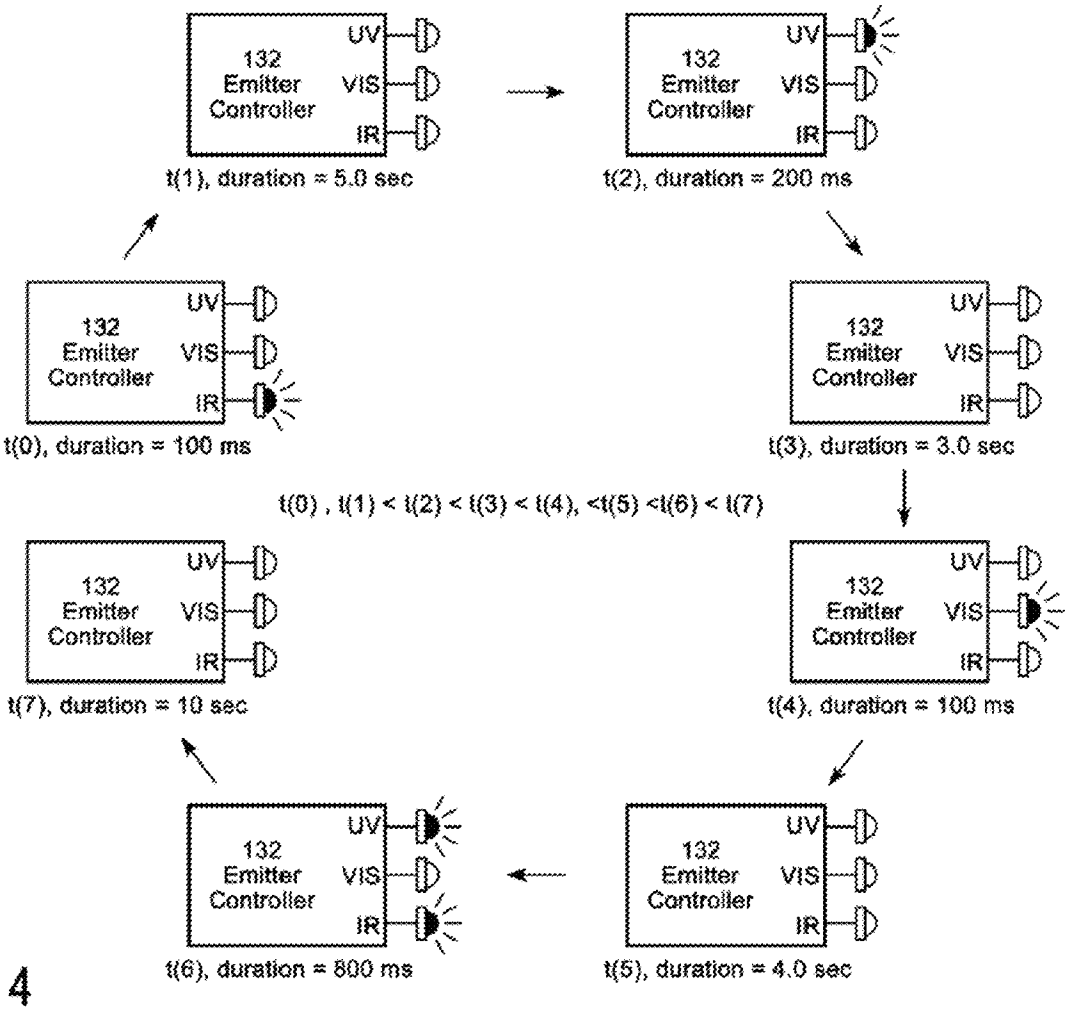
FIG. 4 depicts an image illustrating the performance by an emitter controller of a pseudorandom sequence.
Figure 5A:
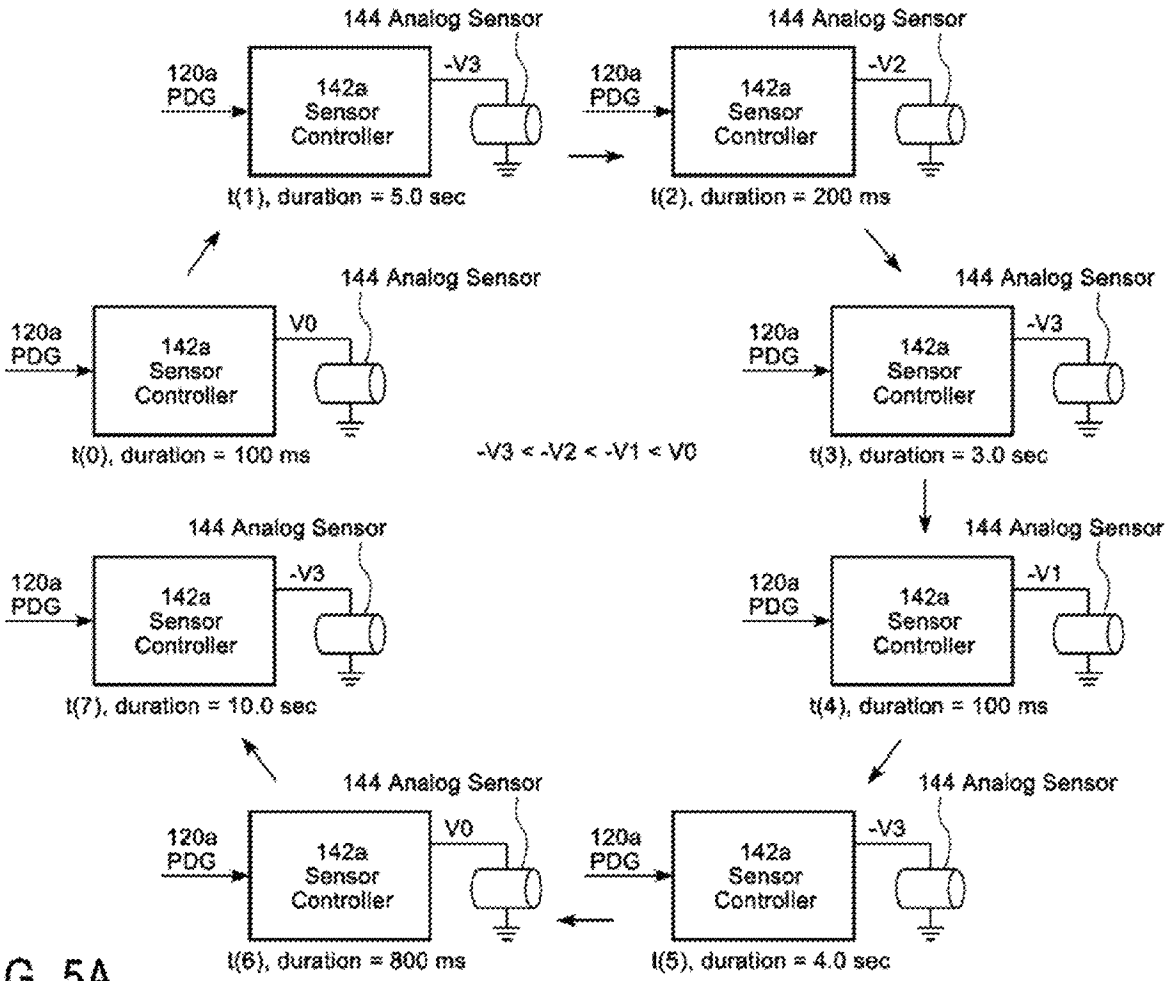
FIG. 5A depicts an image illustrating the performance by a sensor controller of an analog sensor of a pseudorandom sequence.
Figure 5B:
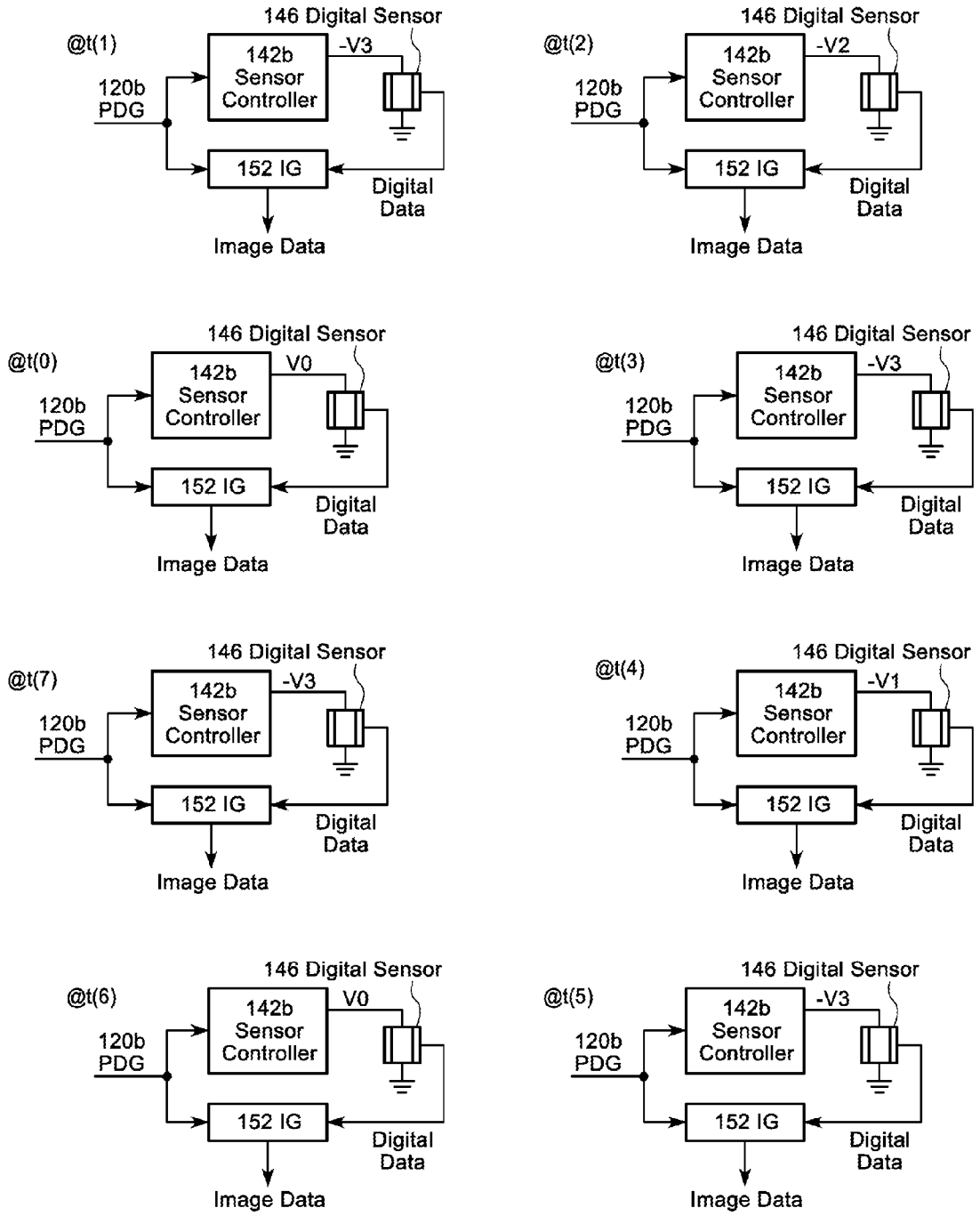
FIG. 5B depicts an image illustrating the performance by a sensor controller of a digital sensor of a pseudorandom sequence.

Some advantages and benefits of the inventive concepts disclosed herein are shown in FIGS. 4 through 5B, illustrating how optoelectronic system may perform by adopting the inventive concepts disclosed herein. Referring now to FIG. 4, assume that the PDG 120 has executed a wavelength hopping function to determine the pseudorandom sequence as a function of time and a cryptographic algorithm and key; the resulting pseudorandom sequence of time durations and wavelength ranges are shown in the table.

As observed, the wavelength hopping function executed by the PDG 120*a* has produced outputs representative of four flashes of radiation at times t(0), t(2), t(4) and t(6), with four pauses at t(1), t(3), t(5), and t(7) of durations of 5.0, 3.0, 4.0, and 10.0 seconds, respectively, in which no flashes of radiation will be generated. Upon acquiring the time duration and wavelength range information from the PDG 120*a* at t(0), the emitter controller 132 could be configured to generate an output which will produce a flash of radiation in the IR wavelength range for a duration of 100 milliseconds. Similarly, upon acquiring the time duration and wavelength range information at t(2), t(4) and t(6), the emitter controller 132 may generate an output which will produce a flashes of radiation in the UV, VIS, and both IR and UV wavelength ranges for durations of 200, 100, and 800 milliseconds, respectively.

Referring now to FIG. 5A, assume that sensor controller 142*a* has acquired the time duration and wavelength range information produced by the PDG 120*a*. Upon acquiring the time duration and wavelength range information, the sensor controller 142*a* could be configured to generate an output which will change the voltage applied to the analog sensor 144 from a normally applied voltage −V3. In this example, it will be assumed that radiation of IR wavelength ranges could diminish or damage the IIT 150, or disrupt or blind a viewer's ability to see a clear image produced by the IIT 150 because of a "blooming" effect resulting from such exposure. To prevent this detrimental effect, the sensor controller 140*a* could be configured to generate an output of zero voltage (shown as V0) for 100 and 800 milliseconds at t(0) and t(6), respectively, preventing electrons from being emitted from the photocathode 162 as it is being struck by IR photons.

The negative effects experienced by the IIT 150 could exist to a lesser extent when being exposed to UV and VIS wavelength ranges. To prevent these detrimental effects, the sensor controller 140*a* could be configured to generate an outputs in between the normal voltage −V3 and V0 to prevent or reduce the detrimental effects. As shown, the sensor controller 140*a* could be configured to generate outputs of −V2 and −V1 for 200 and 100 milliseconds at t(2) and t(4), respectively, reducing the amount of electrons from being emitted from the photocathode 162 as it is being struck by UV and VIS photons, respectively.

Referring now to FIG. 5B, assume that sensor controller 142*b* and the IG 152 has acquired the time duration and wavelength range information produced by the PDG 120*b*. Upon acquiring the time duration and wavelength range information, the sensor controller 142*b* could be configured to generate the same or equivalent output discussed above for the sensor controller 142*a*. In addition, the digital data being produced by the digital sensor 146 could respond to the changes in time duration and wavelength range information provided by the PDG 120*b*.

Upon acquiring at least the time duration information represented in the pulse data acquired from the PDG 120*b*, the IG 152 may be configured to pause the generation of image data, permitting the viewer to continue to view an image of the scene being viewed at the time of the flash. Simultaneous with the output of zero voltage provided by the sensor controller 140*b* at t(0) and t(6), respectively, the IG 152 could pause for 100 and 800 milliseconds, respectively, freezing the image being presented on the DU 154. In some embodiments, the IG 152 could be configured to pause or continue the generation of the image data for 200 and 100 milliseconds in response to the time duration information represented in the pulse data being acquired at t(2) and t(4), respectively. At t(1), t(3), t(5), and t(7), the IG 152 may continue to generate image data without disruption for the durations of 5.0, 3.0, 4.0, and 10.0 seconds, respectively.

Figure 6:
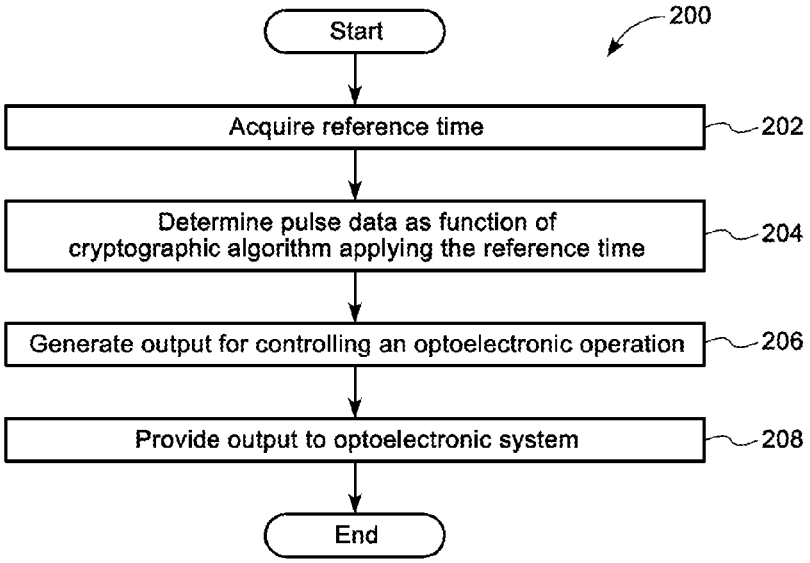
FIG. 6 illustrates a flowchart disclosing an embodiment of a first method performed in an optoelectronic system.
Figure 7:
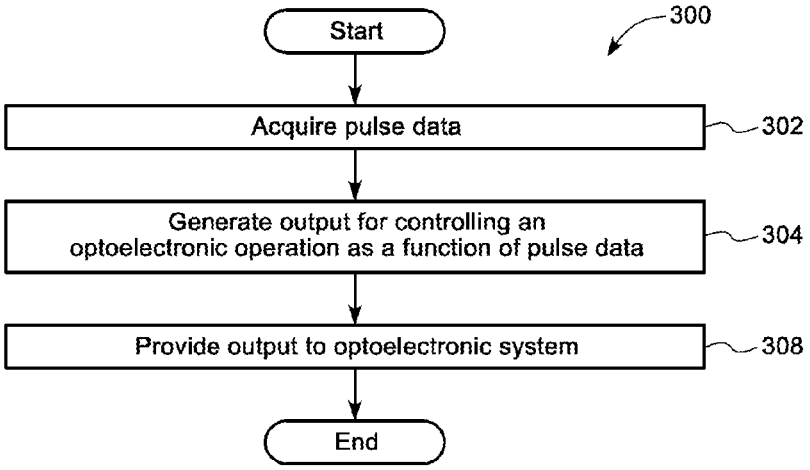
FIG. 7 illustrates a flowchart disclosing an embodiment of a second method performed in an optoelectronic system.
Figure 8:
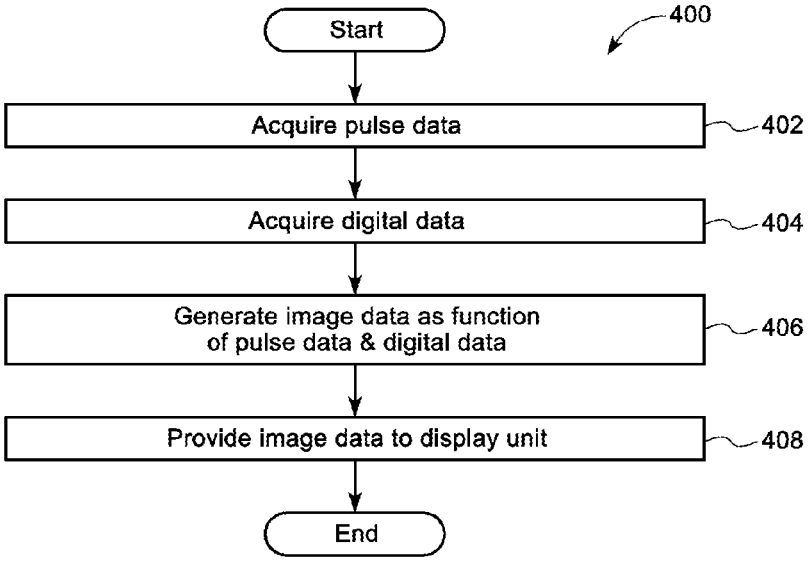
FIG. 8 illustrates a flowchart disclosing an embodiment of a third method performed in an optoelectronic system.

FIGS. 6 through 8 depict flowcharts 200 through 400 providing example methods performed in an optoelectronic system, where PDGs 120*a* and 120*b*, sensor controllers 142*a* and 142*b*, and the IG 152 may be programmed or configured with instructions corresponding to the modules of flowchart 200, 300, and 400, respectively. PDGs 120*a* and 120*b*, sensor controllers 142*a* and 142*b*, and the IG 152 may be a processing unit(s) of a module such as, but not limited to, a printed circuit card assembly having one or more input interfaces (e.g., virtual or physical computer ports) to facilitate data communications, i.e., the receiving and providing of data (e.g., one or more electrical or optical signals including data and/or being indicative of data). For the accomplishment of the following modules embodied in FIGS. 6 through 8, the acquiring of data is synonymous and/or interchangeable with reading, receiving, and/or the retrieval of data.

The method of flowchart 200 begins with module 202 with PDGs 120*a* and/or 120*b* acquiring data representative of a reference time. In some embodiments, the time of day may be provided by clocks 110*a* and/or 110*b* and used for the reference time for establishing a baseline on which the synchronized events of the inventive concepts will occur. In some embodiments, a reference time could be a user-defined time for establishing a baseline on which the synchronized events of the inventive concepts will occur.

The method of flowchart 200 continues with the module 204 PDGs 120*a* and/or 120*b* determining pulse data representative of one or more wavelength ranges and/or one or more times, where the determination may be made as a function of a wavelength hopping algorithm as discussed above applying the reference time. In some embodiments, the time(s) could be comprised of durations of time. In some embodiments, the sequence could include one or more wavelength ranges, where each wavelength range may be matched with one time. In some embodiments, the sequence may not include more than one wavelength range where, for instance, the EDS 130 is configured or equipped with devices emitting only one wavelength range.

The method of flowchart 200 continues with module 206 with PDGs 120*a* and/or 120*b* generating an output as a function of or in response to pulse data. The output could be employed for controlling an operation of one or more optoelectronic systems, where the operation may be susceptible to change. In some embodiments, the optoelectronic system could be the EDS 130, where the operation could include a generation of a flash of radiation. In some embodiments, the optoelectronic system could be RSSs 140*a* or 140*b*, where the operation could include a reduction or suppression of the functionality of the photocathode 162 or 172, respectively. In some embodiments, the output could control an operational change to the IGS 150, where the operation could include a pausing in the generation of image data.

The method of flowchart 200 continues with module 208 with PDGs 120*a* and/or 120*b* providing the output to one or more optoelectronic systems. Then, the method of flowchart 200 ends.

The method of flowchart 300 begins with module 302 with sensor controller 142*a* or 142*b* acquiring pulse data from PDGs 120*a* or 120*b*, respectively. The method of flowchart 300 continues with the module 304 with sensor controller 142*a* or 142*b* generating an output for controlling an operation of RSS 140*a* and 140*b*, respectively, through the analog sensor 144 or the digital sensor 146 as a function of or in response to the acquired pulse data; in response to receiving the output, a functionality of RSS 140*a* and 140*b* may be susceptible to being reduced or suppressed as discussed above. In some embodiments, pulse data may be acquired by the EDS 130; as a function of or in response to receiving the pulse data, the EDS 130 may generate a flash of radiation that is synchronized with the reduction or suppression of the functionality of RSS 140*a* and 140*b*. In some embodiments, pulse data may be acquired by the IDS 150; in response to receiving the pulse data, the generation of the image data may be synchronized with the reduction or suppression of the functionality of the RSS 140*b* and/or the flash of radiation of the EDS 130.

The method of flowchart 300 continues with module 306 with sensor controller 142*a* or 142*b* providing the output to an optoelectronic system. Then, the method of flowchart 300 ends.

The method of flowchart 400 begins with module 402 with the IG 152 acquiring pulse data from the PDG 120*b*. The method of flowchart 400 continues with module 404 with the IG 152 acquiring digital data from the digital sensor 146. In some embodiments, the digital data may be representative of an image being captured by the imaging sensor 174 of the digital sensor 146.

The method of flowchart 400 continues with the module 406 with the IG 152 generating image data representative of an image represented in the digital data acquired from the digital sensor 146 as a function of or in response to the acquired pulse data. In some embodiments, pulse data may be acquired by the EDS 130; as a function of or in response to receiving the pulse data, the EDS 130 may generate a flash of radiation that is synchronized with a pause in the generation of the image data. In some embodiments, the pulse data may be acquired by the RSS 140*b*; in response to receiving the pulse data, a functionality of the RSS 140*b* may be susceptible to being reduced or suppressed as discussed above, and the reduction or suppression of the functionality may be synchronized with a pause in the generation of the image data and/or the flash of radiation of the EDS 130.

The method of flowchart 400 continues with module 408 with the IG 152 providing the image data to one or more display units configured to display the image represented in the image data. Then, the method of flowchart 400 ends It should be noted that the steps of the method described above may be embodied in computer-readable media stored in a non-transitory computer-readable medium as computer instruction code. The method may include one or more of the steps described herein, which one or more steps may be carried out in any desired order including being carried out simultaneously with one another. For example, two or more of the steps disclosed herein may be combined in a single step and/or one or more of the steps may be carried out as two or more sub-steps. Further, steps not expressly disclosed or inherently present herein may be interspersed with or added to the steps described herein, or may be substituted for one or more of the steps described herein as will be appreciated by a person of ordinary skill in the art having the benefit of the instant disclosure.

As used herein, the term "embodiment" means an embodiment that serves to illustrate by way of example but not limitation.

It will be appreciated to those skilled in the art that the preceding examples and embodiments are exemplary and not limiting to the scope of the inventive concepts disclosed herein. It is intended that all modifications, permutations, enhancements, equivalents, and improvements thereto that are apparent to those skilled in the art upon a reading of the specification and a study of the drawings are included within the true spirit and scope of the inventive concepts disclosed herein. It is therefore intended that the following appended claims include all such modifications, permutations, enhancements, equivalents, and improvements falling within the true spirit and scope of the inventive concepts disclosed herein.

What is claimed is:

1. A method performed in an optoelectronic system, comprising:

acquiring, by at least one processor executing processor-executable code, data representative of a reference time;

determining pulse data representative of a pseudorandom sequence comprised of at least one wavelength range and at least one time as a function of the acquired reference time;

generating an output for controlling an operation of at least one optoelectronic system as a function of the pulse data; and providing the output to the at least one optoelectronic system, such that the operation of the at least one optoelectronic system is susceptible to change.

2. The method of claim 1, wherein each one of the at least one time is a duration of time.

3. The method of claim 1, wherein the pseudorandom sequence is comprised of a plurality of wavelength ranges and a plurality of times.

4. The method of claim 1, wherein the at least one optoelectronic system is comprised of:

an optoelectronic system employed to produce an image viewable to a viewer, an optoelectronic system employed to generate a flash of radiation of at the least one wavelength range, or both of these.

5. The method of claim 1, wherein one optoelectronic system is comprised of an optoelectronic system employed to produce an image viewable to a viewer, such that the change is comprised of a reduction or suppression of a photocathode's functionality.

6. The method of claim 1, wherein one optoelectronic system is comprised of a system to generate a flash of radiation of at least one radiation wavelength range, such that the change is comprised of a generation of a flash of radiation.

7. The method of claim 1, wherein the generated output controls an operational change to an image generator, such that the change is comprised of a pause in a generation of image data.

8. A method performed in an optoelectronic system, comprising:

acquiring, by at least one processor executing processor-executable code, pulse data representative of a pseudorandom sequence comprised of at least one wavelength range and at least one time generated as a function of a reference time;

generating an output for controlling an operation of an optoelectronic system employed to produce an image viewable to a viewer as a function of the pulse data; and providing the output to the optoelectronic system, such that a functionality of the optoelectronic system is susceptible to being reduced or suppressed.

9. The method of claim 8, wherein each one of the at least one time is a duration of time.

10. The method of claim 8, wherein the pseudorandom sequence is comprised of a plurality of wavelength ranges and a plurality of times.

11. The method of claim 8, wherein the pulse data is acquired by a second optoelectronic system employed to generate a flash of radiation of at the least one wavelength range as a function of the pulse data, such that the flash of radiation is synchronized with the reduction or suppression of the functionality.

12. The method of claim 8, wherein the pulse data is acquired by an image generating system employed to generate image data representative of an image represented in data acquired from the optoelectronic system as a function of the pulse data, such that the generation of the image data is synchronized with the reduction or suppression of the functionality.

13. The method of claim 12, wherein the pulse data is acquired by a second optoelectronic system employed to generate a flash of radiation of at the least one wavelength range as a function of the pulse data, such that the flash of radiation is synchronized with the reduction or suppression of the functionality and the generation of the image data.

14. A method performed in an optoelectronic system, comprising:

acquiring, by at least one processor executing processor-executable code, pulse data representative of a pseudorandom sequence comprised of at least one wavelength range and at least one time generated as a function of a reference time;

acquiring data from an optoelectronic system;

generating image data representative of an image represented in the data acquired from the optoelectronic system as a function of the pulse data; and providing the image data to at least one display unit, such that the image represented in the image data is presented on the at least one display unit.

15. The method of claim 14, wherein each one of the at least one time is a duration of time.

16. The method of claim 14, wherein the pseudorandom sequence is comprised of a plurality of wavelength ranges and a plurality of times.

17. The method of claim 14, wherein the generation of the image data is susceptible to being paused.

18. The method of claim 14, wherein the pulse data is acquired by the optoelectronic system, such that a functionality of the optoelectronic system is susceptible to being reduced or suppressed as a function of the pulse data, and the reduction or suppression of the functionality is synchronized with a pause in the generation of the image data.

19. The method of claim 14, wherein the pulse data is acquired by a second optoelectronic system employed to generate a flash of radiation of at the least one wavelength range as a function of the pulse data, such that the flash of radiation is synchronized with a pause in the generation of the image data.

20. The method of claim 19, wherein the pulse data is acquired by the optoelectronic system, such that a functionality of the optoelectronic system is susceptible to being reduced or suppressed as a function of the pulse data being acquired, and the reduction or suppression of the functionality is synchronized with the pause and the flash of radiation.

* * * * *